US005329988A

United States Patent [19]

Juger

[11] Patent Number: 5,329,988

[45] Date of Patent: Jul. 19, 1994

[54] HEAT EXCHANGER

[75] Inventor: Joseph S. Juger, Cheshire, Conn.

[73] Assignee: The Allen Group, Inc., New Haven, Conn.

[21] Appl. No.: 69,557

[22] Filed: May 28, 1993

[51] Int. Cl.[5] ..... F28F 1/22

[52] U.S. Cl. ..... 165/153; 165/152

[58] Field of Search ..... 165/152, 153

[56] References Cited

U.S. PATENT DOCUMENTS

| | | | |
|---|---|---|---|
| 858,258 | 6/1907 | Briscoe et al. . | |
| 4,311,193 | 1/1982 | Verhaeghe et al. | 165/149 |
| 4,332,293 | 6/1982 | Hiramatsu | 165/153 |
| 4,373,369 | 2/1983 | Schey | 72/347 |
| 4,377,024 | 3/1983 | Saperstein | 29/157.3 |
| 4,461,348 | 7/1984 | Toge et al. | 165/173 |
| 4,467,511 | 8/1984 | Collgon | 29/157.3 |
| 4,529,034 | 7/1985 | Saperstein | 168/134 |
| 4,633,939 | 1/1987 | Granetzke | 165/154 |
| 4,693,307 | 9/1987 | Scargelletts | 165/153 X |
| 4,730,669 | 3/1988 | Beasley et al. | 165/151 |
| 4,798,241 | 1/1989 | Jarrett et al. | 165/109.1 |
| 4,825,941 | 5/1989 | Hoshino et al. | 165/153 X |
| 4,998,580 | 3/1991 | Guntly et al. | 165/133 |
| 5,025,855 | 6/1991 | Hoshino et al. | 165/153 X |
| 5,033,540 | 7/1991 | Tategami et al. | 165/153 X |
| 5,107,926 | 4/1992 | Calleson | 165/173 |

FOREIGN PATENT DOCUMENTS 2108648 5/1983 United Kingdom .

*Primary Examiner*—John Rivell

*Attorney, Agent, or Firm*—DeLio & Peterson

[57] ABSTRACT

A heat exchanger core comprises a pair of header plates, each of which having a plurality of openings therein, a plurality of oval cross-section heat exchanger tubes adapted to receive a fluid medium therethrough extending in generally spaced parallel relationship between the header plates, the ratio between the major diameter and the minor diameter of each of the tubes being from about 12/1 to about 18/1, each of the plurality of tubes being positioned and arranged such that the ends of each of the tubes are joined to corresponding openings in each of the header plates to form a plurality of tube-to-header joints, and a plurality of louvered serpentine heat transfer fin elements disposed between the header plates in a heat exchange relationship with the plurality of tubes.

13 Claims, 4 Drawing Sheets

HEAT EXCHANGER

BACKGROUND OF THE INVENTION

1. Field of the Invention

This invention relates to heat exchangers and more particularly, to truck and industrial heat exchangers.

2. Description of Related Art

Heat exchangers or radiators utilized in heavy trucks and some industrial applications are typically comprised of cores fabricated from three (3) or four (4) rows of oval shaped solder-coated brass tubes in a heat exchange relationship with corresponding louvered serpentine copper heat transfer fins. A heat exchanger comprising three (3) rows of heat exchanger tubes is known as the 3R VTD core, and a heat exchanger comprising four (4) rows of heat exchanger tubes is known as the 4R VTD core. The maximum fin count in these cores is about 16 fins per inch. Typically, the tubes are separated, in the direction of air flow, by a space of about 0.155 inch. However, it has been found that these spaces between the tubes do not transfer heat and thus, impede the cooling process of the hot fluid flowing through the tubes. Thus, these spaces are essentially wasted. It has also been found that the flat non-louvered portions of the copper fins, between the louver banks, are not as efficient as the louvered portions in effecting transfer of heat from the tubes.

FIG. 2*a* shows a conventional core layout 20 which is known as the 4R VTD heat exchanger. The 4R VTD core 20 is comprised of four (4) rows of heat exchanger tubes 12. The heat exchanger has a core depth $W_A$ of approximately 3.04 inches, a tube centerline spacing $S_A$ of approximately 0.57 inch and a space $F_R$ of approximately 0.155 inch between each heat exchanger tube 12 (in the direction of air flow). The spaces $F_R$ between the heat exchanger tubes do not effectively transfer heat and thus, are essentially wasted. FIG. 2*b* shows the dimensions of the oval heat exchanger tube utilized in the 4R VTD design of FIG. 2*a*. The major and minor diameters $A_R$ and $C_R$, respectively, of tube 12 are approximately 0.625 inch and 0.078 inch, respectively. The ratio of major diameter to minor diameter is approximately 8 to 1 (8/1). The tube wall thickness $T_R$ is approximately 0.008 inches. The hydraulic diameter of tube 12 is about 0.1145 inch.

FIG. 3*a* shows another conventional core layout which is known as a 3R VTD heat exchanger 22. The 3R VTD heat exchanger is comprised of three (3) rows of heat exchanger tubes 12. The heat exchanger has a core depth $W_B$ of approximately 2.29 inches, a tube centerline spacing $S_B$ of approximately 0.57 inch and a space $F_R$ (in the direction of air flow) of approximately 0.155 inch between heat exchanger tubes 12. Similar to the 4R VTD design, the spaces $F_R$ between heat exchanger tubes 12 of the 3R VTD core 22 do not effectively transfer heat and thus, are essentially wasted spaces. FIG. 3*b* shows the dimensions of the oval heat exchanger tubes utilized in the 3R VTD design. The major and minor diameters $A_R$ and $C_R$, respectively, of the heat exchanger tubes 12 are approximately 0.625 inches and 0.078 inches, respectively. The ratio of major diameter to minor diameter is approximately 8 to 1 (8/1), which is the same as in the 4R VTD design. The tube wall thickness $T_R$ is approximately 0.008 inches, which is also the same as the 4R VTD design. The hydraulic diameter of tube 12 in the 3R VTD core is 0.1145 inch, which is the same as in the 4R VTD core.

FIG. 5*a* shows another conventional core layout 28 which is known as the 2R VTD heat exchanger. The 2R VTD core 28 is comprised of two (2) rows of heat exchanger tube 12. The 2R VTD core 28 has a core depth $W_D$ of approximately 1.54 inch, a tube centerline spacing $S_D$ of approximately 0.57 inch and a space $F_R$ of approximately 0.155 inch between tubes 12. As found with the 3R VTD and 4R VTD core layouts, the 0.155 inch space between tubes 12 in the 2R VTD core does not effectively transfer heat and basically amounts to wasted space. FIG. 5*b* shows the heat exchanger tube 12 utilized in the 2R VTD core. This tube has dimensions that are the same as those of the tubes utilized in the 3R VTD and 4R VTD cores and thus, has the same 8 to 1 (8/1) major diameter to minor diameter ratio.

Bearing in mind the problems and deficiencies of the prior art, it is therefore an object of the present invention to provide a new and improved heat exchanger that minimizes or eliminates wasted space between heat exchanger tubes in the direction of air flow, thereby facilitating efficient transfer of heat from the tubes.

It is a further object of the present invention to provide a new and improved heat exchanger that utilizes fewer heat exchanger tubes and heat transfer fins than conventional designs.

It is yet another object of the present invention to provide a new and improved heat exchanger that is smaller in size than the aforementioned conventional heat exchangers but yet, has the ability to cool larger engines.

It is a further object of the present invention to provide a new and improved heat exchanger that is of simple construction and light weight.

It is a further object of the present invention to provide a new and improved heat exchanger that allows vehicle manufacturers to improve vehicle aerodynamics.

It is another object of the present invention to provide a new and improved heat exchanger core that has a core face surface area that is less than that of the aforementioned conventional heat exchangers without sacrificing heat transfer efficiency.

It is another object of the present invention to provide a new and improved heat exchanger that has a core airside pressure drop that is approximately the same as that of the aforementioned conventional heat exchangers.

It is another object of the present invention to provide a heat exchanger that can be manufactured at a reasonable cost.

SUMMARY OF THE INVENTION

The above and other objects, which will be apparent to those skilled in the art, are achieved in the present invention which is directed to a heat exchanger core, comprising a pair of header plates, each of which having a plurality of openings therein, and a plurality of oval cross-section heat exchanger tubes adapted to receive a fluid medium therethrough extending in generally spaced parallel relationship between said header plates. The ratio between the major diameter and the minor diameter of each of the tubes is from about 12/1 to about 18/1, with each of the plurality of tubes being positioned and arranged such that the ends of each of the tubes are joined to corresponding openings in each of the header plates to form a plurality of tube-to-header joints. A plurality of louvered serpentine heat transfer fin elements are disposed between the header plates in a heat exchange relationship with the plurality of tubes, in which the louvers preferably extend substantially the entire fin height.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

Figure 1:
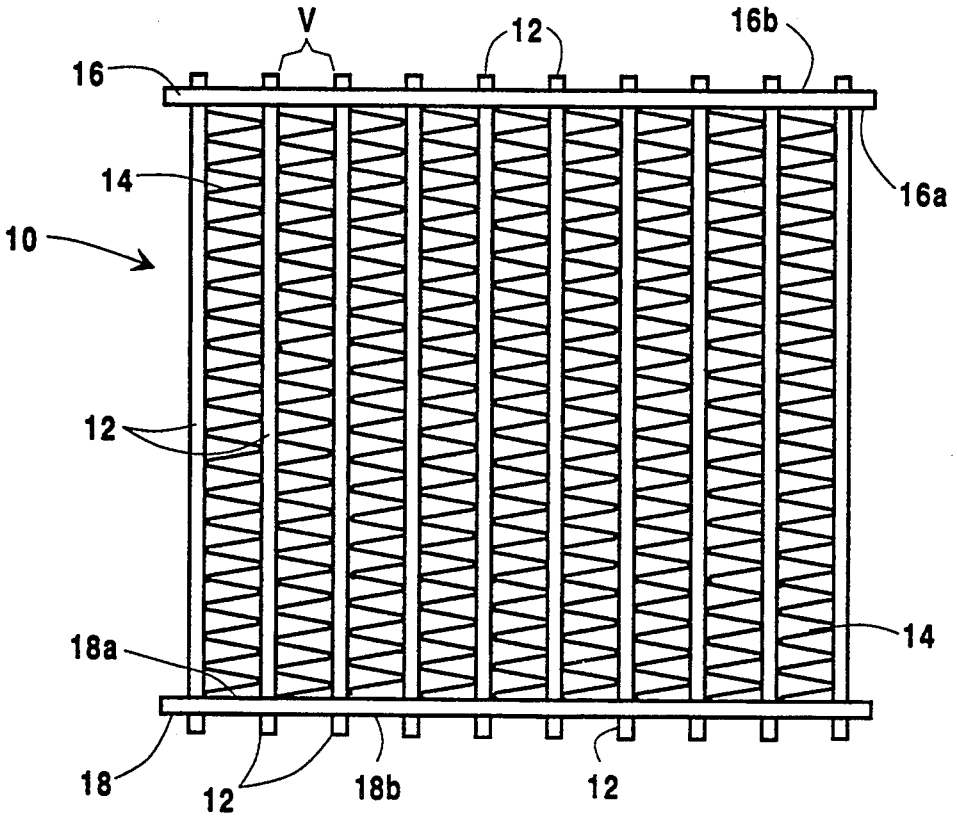
FIG. 1 is a front elevational view of a heat exchanger.
Figure 7A:
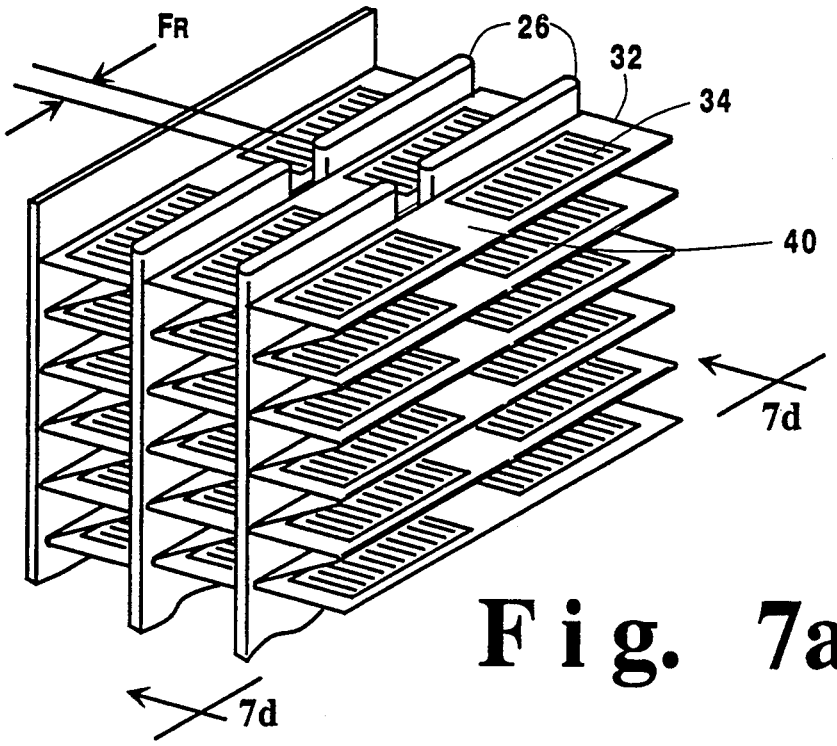
FIG. 7*a* is a perspective view of the heat exchanger of FIG. 4*a* and the serpentine heat transfer fins utilized therein.
Figure 2A:
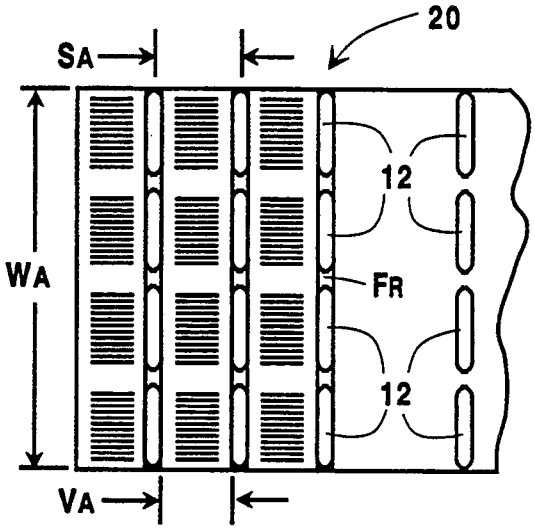
Fig. 2a PRIOR ART
FIG. 2*a* is a top plan view of a conventional heat exchanger utilizing four (4) rows of heat exchanger tubes.
Figure 2B:
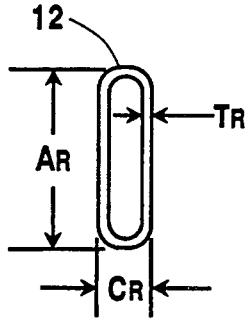
Fig. 2b PRIOR ART
FIG. 2*b* is an end view of a heat exchanger tube utilized in the heat exchanger of FIG. 2*a*.
Figure 3A:
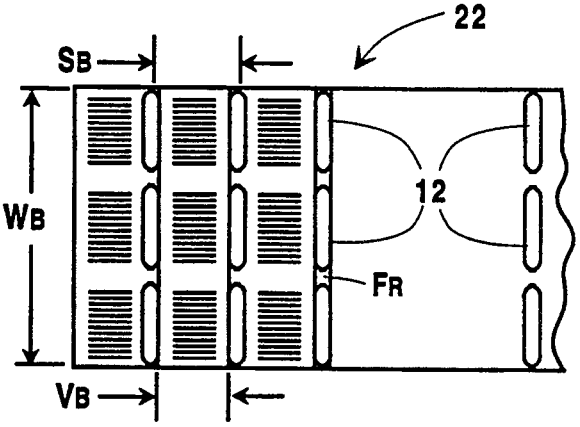
Fig. 3a PRIOR ART
FIG. 3*a* is a top plan view of a conventional heat exchanger utilizing three (3) rows of heat exchanger tubes.
Figure 3B:
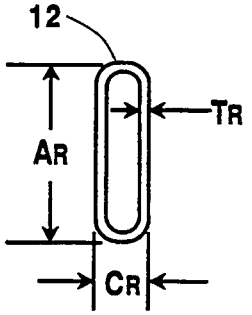
Fig. 3b PRIOR ART
FIG. 3*b* is an end view of a heat exchanger tube utilized in the heat exchanger of FIG. 3*a*.

Referring to FIG. 1, there is shown the assembled basic components of heat exchanger 10 which comprises header plates 16 and 18, interconnecting heat exchanger tubes 12, which extend between upper and lower header plates 16 and 18, and heat transfer fins 14. Heat exchanger tubes 12 are fitted into corresponding openings (not shown) in header plates 16 and 18. Header plates 16 and 18 have liquid-facing sides 16*b* and 18*b*, respectively, and air-facing sides 16*a* and 18*a*, respectively. Heat exchanger tubes 12 are in thermal contact with heat transfer fins 14. Heat exchanger tubes 12 and heat transfer fins 14 comprise what is known as the heat exchanger core components. Tubes 12 are arrayed in a typical parallel configuration and are separated by spaces designated by the letter V in FIG. 1 and $F_R$ in FIG. 7*a*. Serpentine heat transfer fins 14 (shown only partially over the tubes for illustration purposes) are fitted to the tubes to create a stacked core assembly.

Tubes 12 typically have oval ends sized in a particular manner in relation to oval openings on the header plate. As used herein, the term "oval" refers to any noncircular shaped axial cross-section (i.e., perpendicular to the axis of the tube) having a generally smoothly curving periphery, such as an ellipse, a rectangle with rounded corners, or other obround or egg shape. Being of oval cross-sectional shape, such tube ends will have a diameter in one direction greater than the diameter in another (usually perpendicular) direction, which are referred to herein as the "major diameter" and "minor diameter", respectively. Detailed descriptions of heat exchanger design and construction are found in commonly assigned U.S. Pat. Nos. 4,744,505 and 5,150,520, the disclosures of which are herein incorporated by reference.

In order to achieve the aforementioned object of improving heat transfer, the heat exchanger tubes must be bought closer together across the face of the core so as to shorten the length of the path between the hot fluid inside the tube and the cooling airstream, and the ineffective spaces $F_R$ must be minimized or eliminated. In accordance with the present invention, the dimensions of the heat exchanger tubes are changed in order to bring the heat exchanger tubes closer together and reduce the space $F_R$. The oval shape of the tubes facilitates positioning the heat exchanger tubes closer together, hence reducing $F_R$. The major diameter of the heat exchanger tube is increased to about 1 inch. However, the minor diameter of the tube must be reduced in order to keep the Reynolds number approximately the same as that of the 3R VTD and 4R VTD cores. If the minor diameter was not correspondingly reduced, the hydraulic diameter of the tube would be increased and the Reynolds number would be decreased, which would be detrimental to the transfer of heat from the liquid flowing in the tube to the cooling airstream.

Figure 4A:
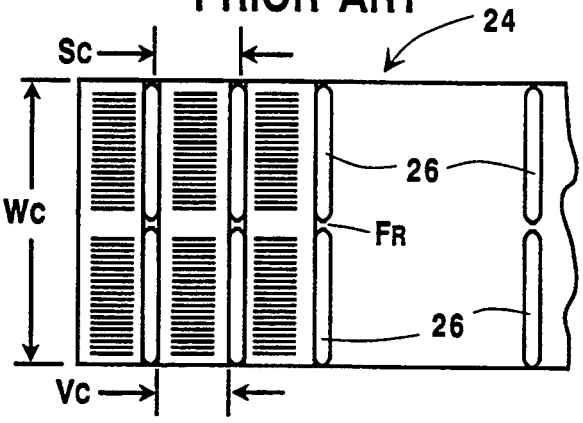
FIG. 4*a* is a top plan view of the heat exchanger of the present invention.
Figure 4B:
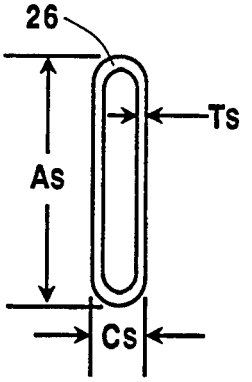
FIG. 4*b* is an end view of an heat exchanger tube utilized in the heat exchanger of FIG. 4*a*.

FIG. 4*a* shows the 2R VTM heat exchanger 24 of the present invention. The 2R VTM heat exchanger has a core depth $W_C$ of about 2.17 inches. The centerline spacing $S_C$ of heat exchanger tubes 26 is about 0.493 inch, which is about 0.077 inch less than the 4R VTD and 3R VTD cores. FIG. 4*b* shows the dimensions of the oval heat exchanger tube 26 utilized in the 2R VTM design. The major and minor diameters of the tube, $A_S$ and $C_S$, respectively are approximately 1.0 inch and 0.067 inch, respectively. The ratio of major diameter to minor diameter is about 14.9 to 1, which is about a 54 percent increase from the major diameter to minor diameter ratios of the 4R VTD and 3R VTD cores. Increasing the major diameter of the tube to 1.0 inch reduces the number of ineffective (wasted) spaces $F_R$ in the direction of air flow from 3 (three) spaces in the 4R VTD design and 2 (two) spaces in the 3R VTD design to 1 (one) space in the 2R VTM design, a significant reduction in wasted space. Increasing the major diameter of the tube also allows a reduction in $F_R$ from 0.155 inch to about 0.140 inch. In a preferred embodiment, $F_R$ is less than or equal to 0.150 inch. The tube wall thickness $T_S$ is from about 0.005 inch to about 0.010 inch. The hydraulic diameter of each tube 26 is about 0.1035.

Table 1 shows other characteristics and advantages of the 2R VTM design. One important advantage of the 2R VTM core is that it requires 100 heat exchanger tubes for a 24 inch wide core, whereas the 4R VTD and 3R VTD cores requires 164 and 123 tubes, respectively. Since the 2R VTM core requires 64 fewer tubes than the 4R VTD core, and 23 fewer tubes than the 3R VTD core, a substantial savings in manufacturing time and costs is realized by utilizing the 2R VTM core. The heat exchanger tube utilized in the 2R VTM core has a tube inside area of 0.0496 square inch, which is greater than the 0.0369 square inch tube inside area of the 4R VTD and 3R VTD cores. Tube inside area is a factor upon which hydraulic diameter is based.

The total flow area of the 2R VTM core is 4.96 square inches, which is about 8.5 percent greater than the 3R VTD, and about 18.1 percent smaller than the 4R VTD core. However, as previously stated, the 2R VTM core requires 64 fewer tubes than the 4R VTD core. The hydraulic diameter of the 2R VTM core is 0.1035 inch, which is about 9.6 percent smaller than the 0.1145 inch hydraulic diameter of the 4R VTD and 3R VTD cores. The kinematic viscosity of the 2R VTM core is 0.0138 ($FT^2/HR$), which is the same as the 3R VTD and 4R VTD cores.

Figure 5A:
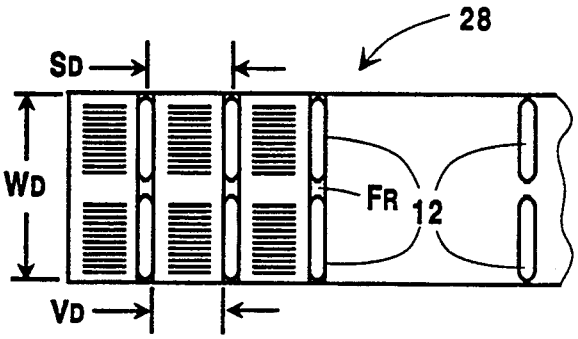
Fig. 5a PRIOR ART
FIG. 5*a* is a top plan view of a conventional heat exchanger utilizing two (2) rows of heat exchanger tubes.
Figure 5B:
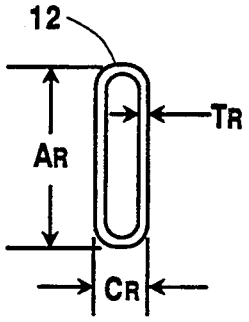
Fig. 5b PRIOR ART
FIG. 5*b* is an end view of a heat exchanger tube utilized in the heat exchanger of FIG. 5*a*.
Figure 6A:
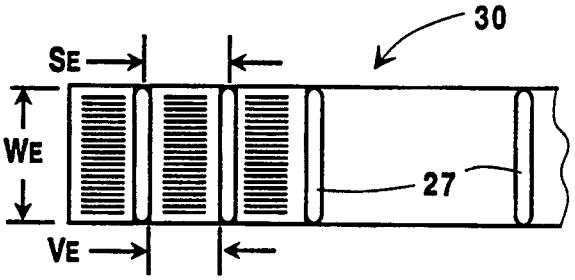
FIG. 6*a* is a top plan view of an alternate embodiment of the heat exchanger of the present invention.

An alternate embodiment of the present invention is the 1R VTM heat exchanger core 30 shown in FIG. 6*a*, which is an improvement over the conventional 2R VTD core 28 shown in FIG. 5a.

Figure 6B:
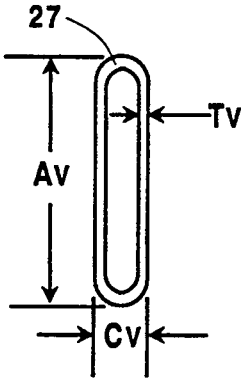
FIG. 6*b* is an end view of a heat exchanger tube utilized in the heat exchanger of FIG. 6*a*.
Figure 7B:
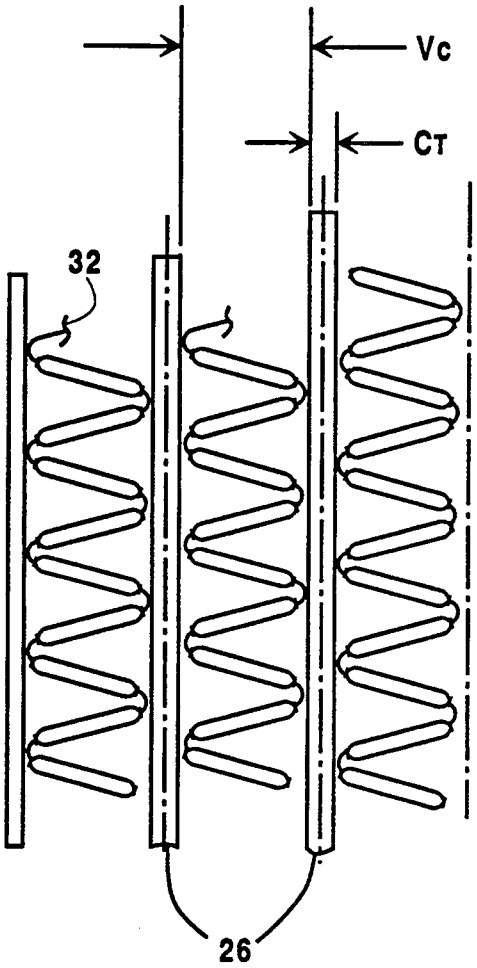
FIG. 7*b* is a partial side elevational view of the serpentine heat transfer fins depicted in FIG. 7*a*.
Figure 7C:
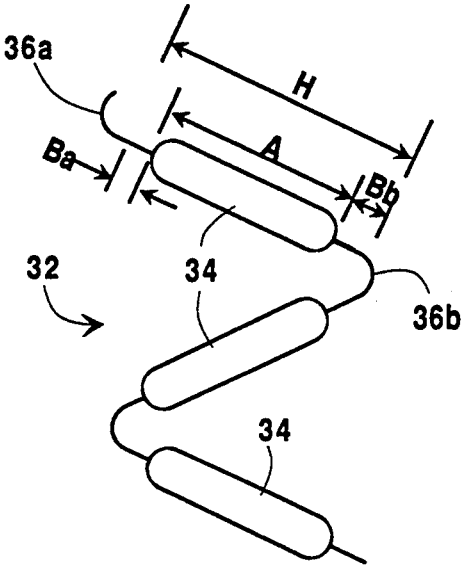
FIG. 7*c* is a partial close-up side elevation view of the louvered serpentine heat transfer fin depicted in FIG. 7*b*.
Figure 7D:
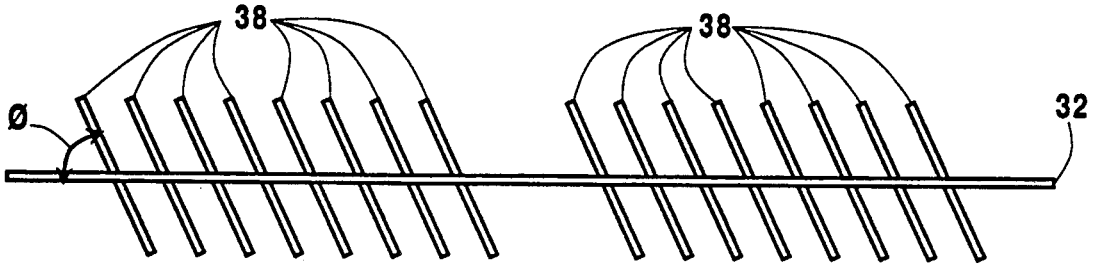
FIG. 7*d* is a side elevational view taken along line 7*d*—7*d* of FIG. 7*a*.

Referring to FIG. 6*a*, the core depth $W_E$ of the 1R VTM core layout 30 is about 1.03 inches, which is about 31.2 percent smaller than the 2R VTD core. The 1R VTM core has one (1) row of heat exchanger tubes 27. Core 30 has a centerline tube spacing $S_E$, which is about 0.493 inch. FIG. 6*b* shows the heat exchanger tube 27 utilized in the 1R VTM core. The major diameter $A_V$ of tube 27 is about 1 inch, and the minor diameter $C_V$ is about 0.067 inch. Hence, the ratio of major diameter to minor diameter is about 14.9 to 1 (14.9/1). The tube wall thickness $T_V$ of tube 27 is from about 0.005 inch to about 0.010 inch.

Table 2 shows other characteristics and advantages of the 1R VTM design. The heat exchanger tube inside area of the 1R VTM core is 0.0496 square inch, which is about a 25.6 percent increase from the 0.0269 square inch tube inside area of the 2R VTD core. The total flow area of the 1R VTM core is 2.48 square inches, which is 18 percent less than the 3.025 square inch flow area for the 2R VTD core. However, the 1R VTM core requires only 50 heat exchanger tubes for a 24 inch wide core, whereas the 2R VTD core requires 82 heat exchanger tubes for the same depth core. Significantly, there are no wasted spaces $F_R$ in the 1R VTM design, compared to 1 (one) space in the 2R VTD design. The 1R VTM design achieves the goal of eliminating wasted spaces $F_R$.

The centerline tube spacing $S_C$ and $S_E$ of the 2R VTM and 1R VTM cores, respectively can be within the range from about 0.40 inch to about 0.55 inch. However, in a preferred embodiment, $S_C$ and $S_E$ are 0.493 inch.

TABLE 1

HEAT EXCHANGER PHYSICAL PROPERTIES

| | PRIOR ART 4RVTD | PRIOR ART 3RVTD | PRESENT INVENTION 2RVTM |
|---|---|---|---|
| CORE PROPERTIES | | | |
| Core Depth (in.) | 3.04 | 2.29 | 2.17 |
| Space Between Tubes (in.) | 0.492 | 0.492 | 0.423 |
| Centerline Tube Spacing (in.) | 0.57 | 0.57 | 0.493 |
| TUBE PROPERTIES | | | |
| Major Diameter (in.) | 0.625 | 0.625 | 1 |
| Minor Diameter (in. | 0.078 | 0.078 | 0.067 |
| Tube Wall Thickness (in.) | 0.008 | 0.008 | .008 |
| Tuber Inside Area (in.$^2$) | 0.0369 | 0.0369 | 0.0496 |
| Tube Rows | 4 | 3 | 2 |
| Number of Tubes (24 inch wide core) | 164 | 123 | 100 |
| Total Flow Area (in.$^2$) | 6.05 | 4.54 | 4.96 |
| Flow Velocity (FT/HR) | 5727 | 7626 | 6981 |
| Hydraulic Diameter (in.) | 0.1145 | 0.1145 | 0.1035 |
| Kinematic Viscosity ($FT^2/HR$) | 0.0138 | 0.0138 | 0.0138 |
| Reynolds Number (30 G.P.M.) | 3943 | 5250 | 4350 |

TABLE 2

HEAT EXCHANGER PHYSICAL PROPERTIES

| | PRIOR ART 2RVTD | PRESENT INVENTION 1RVTM |
|---|---|---|
| CORE PROPERTIES | | |
| Core Depth (in.) | 1.54 | 1.03 |
| Space Between Tubes (in.) | 0.492 | 0.423 |
| Centerline Tube Spacing (in.) | 0.57 | 0.493 |
| TUBE PROPERTIES | | |
| Major Diameter (in.) | 0.625 | 1 |
| Minor Diameter (in. | 0.078 | 0.067 |
| Tube Wall Thickness (in.) | 0.008 | 0.008 |
| Tuber Inside Area (in.$^2$) | 0.0369 | 0.0496 |
| Tube Rows | 2 | 1 |
| Number of Tubes (24 inch wide core) | 82 | 50 |
| Total Flow Area (in.$^2$) | 3.025 | 2.48 |
| Flow Velocity (FT/HR) | 5727 | 6981 |
| Hydraulic Diameter (in.) | 0.1145 | 0.1035 |
| Kinematic Viscosity ($FT^2/HR$) | 0.0138 | 0.0138 |
| Reynolds Number (30 G.P.M.) | 3943 | 4350 |

Three critical properties which determine heat exchanger performance are: (1) total flow area, (2) hydraulic diameter, and (3) Reynolds number. Total flow area is represented by the following relationship:

Total Flow Area = Tube Inside Area × Number of Tubes

Hydraulic diameter is represented by the following relationship:

$$Dh = \frac{4Ai}{Pi}$$

where Dh is the hydraulic diameter, A is the inside tube area and Pi is the inside tube perimeter. The Reynolds number is represented by the following relationship:

$$Re = \frac{VDh}{\nu}$$

where Re is the Reynolds number, V is the flow velocity, Dh is the hydraulic diameter, and $\nu$ is the Kinematic viscosity.

The rate at which heat is exchanged in a heat exchanger, through which a fluid flows, is greatly affected by the nature of that flow, i.e. laminar, turbulent or transitional flow. Generally, the more turbulent the flow, all other things being equal, the greater the rate of heat transfer. The higher the Reynolds number, the more rapid the rate of heat transfer. High Reynolds numbers necessarily employ, all other things being equal, higher fluid velocity which in turn results in higher friction losses and therefore require more energy to generate. However, when low Reynolds numbers are present, difficulties may be encountered due to slight changes in fluid flow which may result in the fluid flow breaking down towards an unstable transition flow, or even laminar flow, thus making it extremely difficult to obtain uniform heat transfer and/or desired rates of heat transfer.

Referring to Table 1, the Reynolds number of fluids flowing in the 4R VTD core and 3R VTD core, at 30 G.P.M. (gallons per minute), are 3943 and 5250, respectively. The Reynolds number of the fluid flowing in the 2R VTM core is about 4350 (at 30 G.P.M.), which is about 9.4 percent greater than the Reynolds number of the 4R VTD core, and about 17 percent less than the 3R VTD core. Hence, the Reynolds number of the 2R VTM core is within the range set by the aforementioned conventional cores and thus, does not present the aforementioned problems associated with high or low Reynolds numbers.

Referring to Table 2, the Reynolds number of fluids flowing through the 1R VTM core is 4350, which is only 9.4 percent greater then the 2R VTD Reynolds number of 3943. Similar to the 2R VTM Reynolds number, the 1R VTM Reynolds number does not present the aforementioned problems associated with high or low Reynolds numbers.

Heat exchanger tubes 26 and 27 are butt-welded solder-coated brass tubes. In a preferred embodiment, the heat exchanger tubes 26 and 27 have a major diameter to minor diameter ratio of about 14 to 1 (14/1 ). The major diameters $A_S$ and $A_V$ of tubes 26 and 27, respectively, can be within the range from about 0.90 inch to about 1.1 inches. The minor diameters $C_S$ and $C_V$ of tubes 26 and 27, respectively, can be within the range from about 0.060 inch to about 0.075 inch. Hence, the ratio of major diameter to minor diameter of tubes 26 and 27 can be within a range from about 12 to about 18.3. Since tubes 26 and 27 have a minor diameter (width) $C_S$ and $C_V$ respectively, which is narrower than conventional tubes 12, tubes 26 and 27 have a hydraulic diameter that is smaller than that of tubes 12. The smaller hydraulic diameter improves fluid turbulence inside the tube which facilitates efficient transfer of heat from the fluid flowing through the tube. The reduction of the spaces between the tubes optimizes heat transfer versus core airside pressure drop.

The 1R VTM and 2R VTM heat exchanger cores of the present invention utilize serpentine copper heat transfer fins in a heat exchange relationship with tubes 26 and 27. FIG. *7a* shows the 2R VTM core of the present invention utilizing serpentine copper heat transfer fins 32 which are in heat exchange contact with tubes 26 and extend across the space between tubes 26. Each fin 32 has louvered surface 34 thereon and intermediate crests (serpentine radii) 36*a* and 36*b*. Referring to FIGS. *7b–7d*, louvered surface 34 is designated by the letter A and is comprised of louvers 38. Louvers 38 run in length from crest 36*a* to crest 36*b* for a total length greater than or equal to about 75 percent of the total fin height H. In a preferred embodiment, louvers 38 run in length from crest 36*a* to crest 36*b* for a total length equal to about 88 to 94 percent of the fin height. For instance, and referring to FIG. *7c*, the total fin height H between crest 36*a*, 36*b* is represented by the sum:

$$H=A+B_a+B_b$$

where A presents the length of the louvered surface, and $B_a$ and $B_b$ represent the unlouvered surfaces of the fin. The louvered surface A is represented by the following relationship:

$$0.88 \leqq A/H \leqq 0.94$$

The louvers extend across the face of the fin convolution on the top and bottom surfaces of the fin. The width of each fin louver is from about 0.03 inch to about 0.045 inch, which is narrower than the louvers of conventional fins. The narrow louvered surfaces provide maximum heat transfer of heat from the heat exchanger tubes. The fin louver angle $\emptyset$, as shown in FIGS. *7d*, is less than 30 degrees, which is lower than that of conventional heat transfer fins. In a preferred embodiment, the fin louver angle $\emptyset$ is from about 18 degrees to about 25 degrees. The lower louver angle decreases fin airside resistance so as to offset the increase in airside resistance caused by making the heat exchanger tubes closer together across the face of the core. This optimizes the amount of resulting air turbulation while keeping overall airside pressure loss at a minimum. Since the louvers are narrow and have a lower angle, the fins can be spaced closer together, resulting in possible fin counts as high as 18 fins per inch. Furthermore, since tubes 26 and 27 are closer together than in the conventional cores, due to the reduction of $F_R$, the fin height $V_C$ and $V_E$ of the 2R VTM core and the 1R VTM core, respectively, is about 0.423 inch, as compared to the 0.492 inch fin height of the 4R VTD, 3R VTD and 2R VTD cores, designated by $V_A$, VB and VD, respectively (see FIGS. *2a*, *3a* and *5a*). The reduction of the space $F_R$ also results in a reduction in the number and size of the ineffective flat unlouvered surfaces 40 on fins 32. Although a fin height of 0.423 inch is preferred, the fin height can be in the range from about 0.325 inch to about 0.490 inch. This decrease in fin height also contributes to the improvement of heat transfer from the fluids flowing through tubes 26 and 27.

The space $F_R$ between the heat exchanger tubes (tube row spacing) in the front-to-back direction of the 2R VTM core is less than the tube row spacing in the conventional heat exchanger cores. This space is necessary in order to allow room for drawn collars to be made in the header to facilitate the attachment of the header plate to the tubes. Increasing the major diameter of the tubes, however, results in fewer tubes for a given core depth and minimizes or eliminates the wasted space $F_R$. The closer tube spacing, narrow louvers, low louver angle, increased tube major diameter, and narrow tube minor diameter all contribute to the increased heat transfer capability of the 1R VTM and 2R VTM cores. The minimization or elimination of the spaces $F_R$ also reduces the size of the ineffective flat unlouvered areas on the heat transfer fins. The narrower tube width (minor diameter) provides a smaller tube opening which results in improved fluid turbulation at low coolant flows. This feature makes the 1R VTM and 2R VTM heat exchanger cores particularly suitable for use with heavy truck engines which have lower than usual coolant flows. The 1R VTM and 2R VTM designs are also suitable for engines having high horse power ratings and higher heat loads.

The heat exchanger core design of the present invention provides improved heat transfer capability without an increase in heat exchanger core face area or core depth. Additionally, since there are fewer tubes in the heat exchanger core embodiments of the present invention, labor and manufacturing costs are significantly reduced. For instance, due to the reduced core thickness of the 1R VTM and 2R VTM cores, fewer tubes and heat transfer fins are utilized thereby providing a substantial savings in materials. Furthermore, the utilization of fewer tubes results in fewer tube-to-header joints and thus, fewer opportunities for fluid leaks. Additionally, all tubes of the 1R VTM and 2R VTM designs are accessible from either the front or the rear of the heat exchanger core. There are no hidden middle rows of tubes. Hence, core inspection and repair is easier during the manufacturing process and in the field. A further advantage of the heat exchanger of the present invention is that, due to its smaller size, vehicle manufacturers can improve vehicle aerodynamics with respect to the design of engine hoods.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A heat exchanger core, comprising:

a pair of header plates, each of which having a plurality of openings therein;

a plurality of oval cross-section heat exchanger tubes adapted to receive a fluid medium therethrough extending in generally spaced parallel relationship between said header plates, the ratio between the major diameter and the minor diameter of each of said tubes being from about 12/1 to about 18/1, each of said plurality of tubes being positioned and arranged such that the ends of each of said tubes are joined to corresponding openings in each of said header plates to form a plurality of tube-to-header joints; and a plurality of louvered serpentine heat transfer fin elements disposed between said header plates in a heat exchange relationship with said plurality of tubes.

2. The heat exchanger of claim 1 wherein each of said tubes has a major diameter from about 0.9 inch to about 1.1 inches, and a minor diameter from about 0.067 inch to about 0.075 inch.

3. The heat exchanger of claim 2 wherein the heat exchanger tube wall thickness is from about 0.005 inch to about 0.010 inch.

4. The heat exchanger of claim 3 wherein the hydraulic diameter of each of said tubes is about 0.1035 inch.

5. The heat exchanger of claim 4 wherein said tubes are centerline spaced from about 0.4 inch to about 0.55 inch apart across the face of the core and are spaced from about 0.1 inch to about 0.150 inch apart in the direction of air flow.

6. The heat exchanger of claim 5 wherein the height of each of said heat transfer fin elements is from about 0.325 inch to about 0.490 inch.

7. The heat exchanger of claim 1 wherein each of said heat transfer fin elements has a plurality of louvers thereon which extend over the top and bottom surfaces of said fin element for at least 75 percent of the fin element height.

8. The heat exchanger of claim 1 wherein the width of each of said serpentine fin louver elements is from about 0.03 inch to about 0.045 inch in order to facilitate efficient dissipation of heat from each of said plurality of tubes.

9. The heat exchanger of claim 6 wherein the serpentine heat transfer fin louver angle is less than 30 degrees.

10. The heat exchanger of claim 1 each of said tubes is a butt-welded solder coated brass tube.

11. The heat exchanger of claim 1 wherein each of said serpentine heat transfer fins is made of copper.

12. The heat exchanger of claim 5 wherein said plurality of tubes comprises one (1) row of heat exchanger tubes.

13. The heat exchanger of claim 5 wherein said plurality of tubes comprises two (2) rows of heat exchanger tubes.

* * * * *